United States Patent [19]

Henn et al.

[11] Patent Number: 5,054,765

[45] Date of Patent: Oct. 8, 1991

[54] SHEET STOP FOR A SHEET DELIVERY APPARATUS OF A PRINTING PRESS

[75] Inventors: Manfred Henn, Heidelberg; Carsten Kelm, Mannheim, both of Fed. Rep. of Germany

[73] Assignee: Heidelberger Druckmaschinen AG, Heidelberg, Fed. Rep. of Germany

[21] Appl. No.: 521,431

[22] Filed: May 10, 1990

[51] Int. Cl.[5] ..... B65H 31/04; B65H 31/26

[52] U.S. Cl. ..... 271/213; 271/220

[58] Field of Search ..... 271/213, 214, 215, 217, 271/220, 223

[56] References Cited

U.S. PATENT DOCUMENTS

| | | | |
|---|---|---|---|
| 930,097 | 8/1909 | Sheldon | 271/220 X |
| 1,194,328 | 8/1916 | Cheshire . | |
| 2,991,999 | 7/1961 | Doerner | 271/220 |
| 3,805,971 | 4/1974 | Beitrens et al. | 271/220 X |
| 4,511,301 | 4/1985 | Kawano et al. | 271/213 X |
| 4,776,578 | 10/1988 | Hirakawa et al. | 271/223 |

FOREIGN PATENT DOCUMENTS

| | | | |
|---|---|---|---|
| 400476 | 8/1924 | Fed. Rep. of Germany . | |
| 140425 | 6/1986 | Japan | 271/220 |

*Primary Examiner*—Robert P. Olszewski
*Assistant Examiner*—Boris Milef
*Attorney, Agent, or Firm*—Nils H. Ljungman & Associates

[57] ABSTRACT

A sheet delivery apparatus for a printing press comprising an intermediate stacking device for the printed sheets, the intermedite stacking device being mounted so as to be liftable and lowerable, and stops for the delivered sheets, the stops being pivotally mounted on pivots and able to follow the lifting movement of the stacking table, the stops performing an approximately perpendicular movement in an articulated manner in order to eliminate any disturbances occurring during operation.

15 Claims, 1 Drawing Sheet

SHEET STOP FOR A SHEET DELIVERY APPARATUS OF A PRINTING PRESS

BACKGROUND OF THE INVENTION

1.. Field of the Invention

The present invention relates to a sheet delivery apparatus for a printing press, which includes an intermediate stacking device for the printed sheets, the intermediate stacking device being mounted so as to be capable of being lifted and lowered, respectively, and stops for positioning the delivered sheets, the stops being pivotally mounted on pivots so as to be able to follow the lifting movement of a sheet-stacking table.

2. Background Information

German Patent No. 400 476 relates to such a sheet delivery apparatus, and discloses stops which consist of rotatably mounted levers, arranged such that they follow the perpendicular movement of the sheet-stacking table and remain in contact with the sheet-stacking table while a stack is being formed thereon, with the rotatably mounted levers swivelling in perpendicular planes and being arranged obliquely with respect to the sheet-stacking table, thus preventing the printed sheets from slipping through the interval between the levers and the stops.

Such a construction has the disadvantage that difficulties can arise in the case where an intermediate stacking device is employed which is designed as a rake consisting of individual bars. In contrast to the use of a solid stacking table, the use of a rake bears the risk that the stops may collide with the bars of the rake during the lifting and lowering movement of the intermediate stacking table, thereby damaging the bars and the stops, particularly during the lifting movement of the rake. To avoid such damage, there is the possibility of spacing, in the range of the stops, the bars to be delivered to buckle considerably downward in the range of the interval between the bars. This may damage the delivered sheets, when depositing the intermediate stack, after the intermediate stack has reached a maximum height, on a stacking table or on a pallet.

OBJECT OF THE INVENTION

One object of the present invention is the provision of stops for a sheet-stacking table, which includes an intermediate stacking device, which stops substantially prevent any disturbances from occurring during operation of the printing press.

SUMMARY OF THE INVENTION

According to the invention, this object and other objects are achieved by pivotally mounting the stops on pivots which can be displaced in horizontal slots provided in a mounting member, and in connecting levers with the stops in an articulated manner, the levers being pivotable about further pivots provided on the mounting member, and in displacing the pivots of the stops when lifting the stops, such that the lower parts of the stops perform an approximately perpendicular movement. With such a construction, the rake bars of the intermediate stacking device may feature normal spacing, and may be lifted and lowered without causing a collision between the stops and the rake bars. It is also possible to extend the length of the stroke of the intermediate stacking device by enlarging the stops, so that a higher intermediate stack can be formed. In so doing, the stack-changing periods can be prolonged, even during the processing of thicker sheets of paper.

One aspect of the invention resides broadly in a sheet delivery apparatus for a printing press for the production of printed sheets and the sequential horizontal delivery of the printed sheets to a sheet delivery location. The sheet delivery apparatus includes: receiving surface device for receiving the sequentially horizontally delivered printed sheets, one after the other, so as to produce a stack of the printed sheets; height adjustment device for selectively vertically displacing the receiving surface device: stop member device for contacting the sequentially delivered printed sheets, at least a portion of the stop member device being positioned adjacent the receiving surface device: and substantially vertical stop member displacement device being configured for producing a substantially vertical displacement of at least a lower portion of the stop member device.

Another aspect of the invention resides broadly in a sheet delivery apparatus for a printing press for the production of printed sheets and the sequential horizontal delivery of the printed sheets to a sheet delivery location. The sheet delivery apparatus includes: receiving surface device for receiving the sequentially horizontally delivered printed sheets, one after the other, so as to produce a stack of the printed sheets: height adjustment device for selectively vertically displacing the receiving surface device; stop member device for stopping the horizontal travel of the sequentially delivered printed sheets, at least a portion of the stop member device being positioned adjacent the receiving surface device; and substantially vertical stop member displacement device being configured for producing a substantially vertical displacement of at least a lower portion of the stop member device.

Yet another aspect of the invention resides broadly in a printing press having a sheet delivery apparatus. The printing press is for the production of printed sheets and the sequential horizontal delivery of the printed sheets to a sheet delivery location. The sheet delivery apparatus includes: receiving surface device for receiving the sequentially horizontally delivered printed sheets, one after the other, so as to produce a stack of the printed sheets; height adjustment device for selectively vertically displacing the receiving surface device: stop member device for stopping the horizontal travel of the sequentially delivered printed sheets, at least a portion of the stop member device being positioned adjacent the receiving surface device: and substantially vertical stop member displacement apparatus being configured for producing a substantially vertical displacement of at least a lower portion of the stop member device.

The detailed description of a preferred embodiment of the invention, hereinafter described, is better understood when taken in conjunction with the appended drawing, briefly described below.

DESCRIPTION OF THE PREFERRED EMBODIMENT

Figure 1:
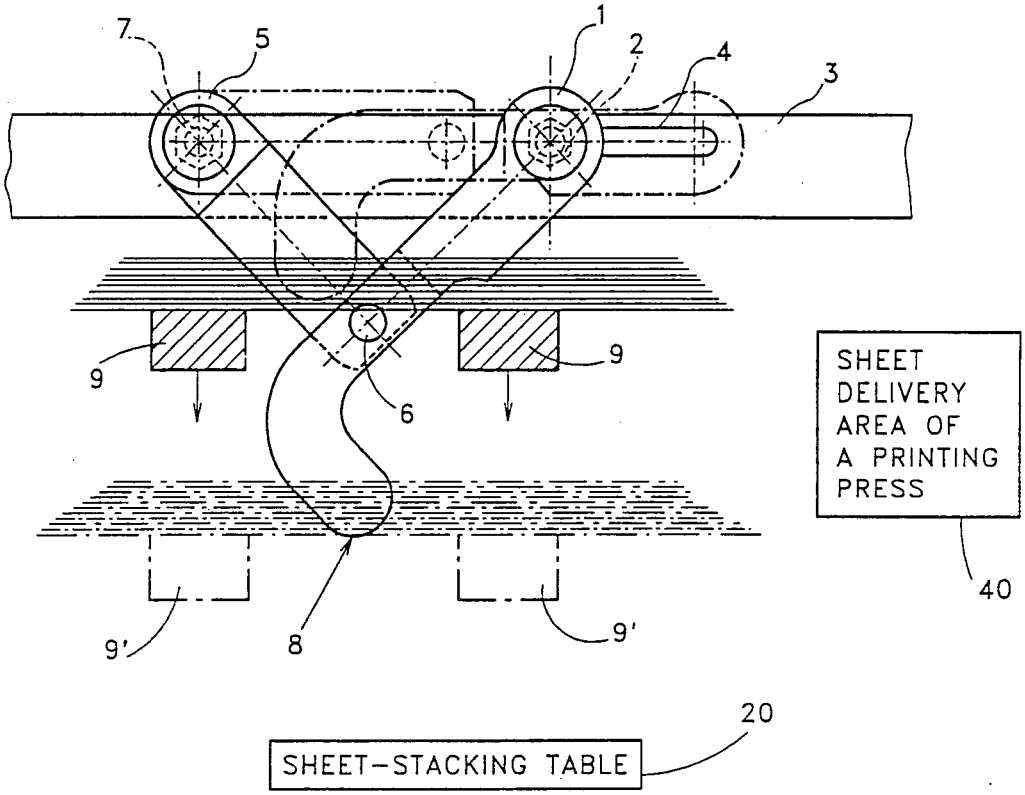
FIG. 1 is an elevational, sectional view of a sheet delivery apparatus constructed according to the invention.

FIG. 1 is a sectional view of an intermediate stacking device located near the sheet delivery area of a printing press, and constructed according to the invention. Indicated schematically in FIG. 1 are a printing press 30 and the sheet delivery area 40 of the printing press 30. The intermediate stacking device has stops 1, which are pivotally mounted on pivots 2, which can be horizontally displaced in horizontally disposed slots 4. The slots 4 are preferably provided in a mounting member 3, which is fastened to the machine side frames.

The stops 1 are pivotally mounted on the pivots 2 and may, therefore, follow the lifting movement of the sheet-stacking table 20 (schematically illustrated). Preferably, the sheet-stacking table 20 is adjustably lowerable, to provide for the formation thereon of a stack of printed sheets. Sheet stacking tables are well known in the art, and examples of some may be found in U.S. Pat. No. 4,332,376, issued on June 1, 1982 to Volpe and entitled "Mechanism for Stacking Sequentially Received Sheets" and in U.S. Pat. No. 3,966,192, issued June 29, 1976 to Jeschke and entitled "Sheet Pile Elevator in Sheet Delivery Systems for Printing Machines."

Via a pivot 6, a lever 5 is connected with the stops 1 in an articulated manner. The lever 5 is preferably fastened to the mounting member 3, so as to pivot about a pivot 7, which may, for example, be a screw. When lifting the stop 1 into the position indicated by the dashed-and-dotted line shown in FIG. 1, the pivot 2 of the stop 1 is displaced in the horizontal slot 4, as also indicated by a dashed-and-dotted line. In so doing, the lower part 8 of the stop 1 is displaced in an approximately perpendicular fashion, so that it may be inserted between the rake bars 9 of an intermediate stacking device without colliding therewith.

As illustrated in FIG. 1, the stop 1 is generally L-shaped and has an outstanding leg portion 8 projecting towards the stacking table, so that the bars 9 may be moved into the lower position 9' as indicated by a dashed-and-dotted line. The outer projecting end of the outstanding leg portion has a curved surface. It is, therefore, possible to have a relatively great distance between the arriving sheet and the maximumly lowered main stack, in order to be able to insert the rake of the intermediate stacking device without creating any problems.

Published German Patent Application No. G 89 03 802.9 (which corresponds to U.S. application Ser. No. 07/495,378, filed Mar. 16, 1990 by Henn, et al. and entitled "Sheet Delivery Apparatus for Rotary Printing Presses") relates to an apparatus for forming a temporary pile of delivered sheets on a bar grate and is, therefore, directed to subject matter similar to that of the present application.

In summary, one feature of the invention resides broadly in a sheet delivery at a printing machine comprising a stacking device for the printed sheets, said stacking device being mounted so that it can be lifted and respectively lowered, and stops for the sheets to be delivered, said stops being pivot-mounted on pivots and being able to follow the lifting movement of the stacking table, characterized in that stops 1 are pivot-mounted on pivots 2 which can be displaced in horizontal slots 4 provided in a mounting 3, and that levers 5 are connected with said stops 1 in an articulated manner, said levers 5 being pivot-mounted on pivots 7 provided at said mounting 3 and displacing said pivots 2 of said stops 1 in said slots 4 when lifting said stops 1 so that lower parts 8 of said stops 1 perform an approximately perpendicular movement.

Another feature of the invention resides broadly in a sheet delivery characterized in that said lower parts 8 of said stops 1 are bent downward.

All of the patents, patent applications, and publications recited herein, if any, are hereby incorporated by reference as if set forth in their entirety herein.

The details in the patents, patent applications, and publications may be considered to be incorporable, at applicant's option, into the claims during, prosecution as further limitations in the claims to patentably distinguish any amended claims from any applied prior art.

The invention as described hereinabove in the context of the preferred embodiment is not to be taken as limited to all of the provided details thereof, since modifications and variations thereof may be made without departing from the spirit and scope of the invention.

What is claimed is:

1. A sheet delivery apparatus for a printing press, the printing press being for the production of printed sheets and the sequential horizontal delivery of the printed sheets to a sheet delivery location, said sheet delivery apparatus comprising:

receiving surface means for receiving the sequentially horizontally delivered printed sheets, one after the other, so as to produce a stack of the printed sheets;

height adjustment means for selectively vertically displacing said receiving surface means;

stop member means for contacting the sequentially delivered printed sheets, at least a portion of said stop member means being positioned adjacent said receiving surface means;

generally vertical stop member displacement means being configured for producing a generally vertical displacement of at least a lower portion of said stop member means;

wherein said stop member means comprises a substantially elongated stop member, a first end of said substantially elongated stop member being said lower portion of said stop member means and being positioned adjacent said receiving surface means, and wherein said generally vertical stop member displacement means comprises:

first pivotal mounting means for pivotally mounting the second end of said substantially elongated stop member to the printing press;

substantial horizontal displacement guide means for guiding a substantially horizontal displacement of the pivotally mounted second end of said substantially elongated stop member; and a lever arm, a first end of said lever arm being pivotally connected to the printing press, and the second end of said lever arm being pivotally connected to said substantially elongated stop member.

2. A sheet delivery apparatus according to claim 1, further comprising a substantially elongated mounting member, said substantially elongated mounting member being connected to the printing press and disposed substantially horizontally, said substantially elongated mounting member having a substantially horizontally disposed slot formed therein, wherein said substantial horizontal displacement guide means for guiding the substantially horizontal displacement of said pivotally mounted second end of said substantially elongated stop member comprises the positioning of said first pivotal mounting means within said substantially horizontally disposed slot for sliding substantially horizontal movement therein, and wherein said first end of said lever arm is pivotally connected to said mounting member.

3. A sheet delivery apparatus according to claim 2, wherein said pivotal connection of said first end of said lever arm to said mounting member is substantially horizontally spaced from said substantially horizontally disposed slot formed in said mounting member.

4. A sheet delivery apparatus according to claim 3, wherein said substantially elongated stop member comprises a substantially L-shaped member, said substantially L-shaped member having an outstanding leg portion projecting towards said receiving surface means.

5. A sheet delivery apparatus according to claim 4, wherein said second end of said lever arm is pivotally connected to said substantially elongated stop member substantially intermediate said outstanding leg portion and said second end of said substantially elongated stop member.

6. A sheet delivery apparatus according to claim 5, wherein the outer projecting end of said outstanding leg portion has a curved surface.

7. A sheet stop apparatus for a sheet delivery apparatus of a printing press, the printing press being for the production of printed sheets and the sequential horizontal delivery of the printed sheets to a sheet delivery location, said sheet stop apparatus comprising:

receiving surface means for receiving the sequentially horizontally delivered printed sheets, one after the other, so as to produce a stack of the printed sheets;

height adjustment means for selectively vertically displacing said receiving surface means;

stop member means for stopping the horizontal travel of the sequentially delivered printed sheets, at least a portion of said stop member means being positioned adjacent said receiving surface means;

generally vertical stop member displacement means being configured for producing a generally vertical displacement of at least a lower portion of said stop member means;

wherein aid stop member means comprises a substantially elongated stop member, a first end of said substantially elongated stop member being said lower portion of said stop member means and being positioned adjacent said receiving surface means, and wherein said generally vertical stop member displacement means comprises:

first pivotal mounting means for pivotally mounting the second end of said substantially elongated stop member to the printing press;

substantially horizontal displacement guide means for guiding a substantially horizontal displacement of the pivotally mounted second end of said substantially elongated stop member; and a lever arm, a first end of said lever arm being pivotally connected to the printing press, and the second end of said lever arm being pivotally connected to said substantially elongated stop member.

8. A sheet stop apparatus according to claim 7, further comprising a substantially elongated mounting member, said substantially elongated mounting member being connected to the printing press and disposed substantially horizontally, said substantially elongated mounting member having a substantially horizontally disposed slot formed therein, wherein said substantial horizontal displacement guide means for guiding the substantially horizontal displacement of said pivotally mounted second end of said substantially elongated stop member comprises the positioning of said first pivotal mounting means within said substantially horizontally disposed slot for sliding substantially horizontal movement therein, and wherein said first end of said lever arm is pivotally connected to said mounting member.

9. A sheet stop apparatus according to claim 8, wherein said substantially elongated stop member comprises a substantially L-shaped member, said substantially L-shaped member having an outstanding leg portion projecting towards said receiving surface means, wherein said second end of said lever arm is pivotally connected to said substantially elongated stop member substantially intermediate said outstanding leg portion and said second end of said substantially elongated stop member, and wherein the outer projecting end of said outstanding leg portion has a curved surface.

10. A printing press having a sheet delivery apparatus, the printing press being for the production of printed sheets and the sequential horizontal delivery of the printed sheets to a sheet delivery location, said sheet delivery apparatus comprising:

receiving surface means for receiving the sequentially horizontally delivered printed sheets, one after the other, so as to produce a stack of the printed sheets;

height adjustment means for selectively vertically displacing said receiving surface means;

stop member means for contacting the sequentially delivered printed sheets, at least a portion of said stop member means being positioned adjacent said receiving surface means;

generally vertical stop member displacement means being configured for producing a generally vertical displacement of at least a lower portion of said stop member means;

wherein said stop member means comprises a substantially elongated stop member, a first end of said substantially elongated stop member being said lower portion of said stop member means and being positioned adjacent said receiving surface means, and wherein said generally vertical stop member displacement means comprises:

first pivotal mounting means for pivotally mounting the second end of said substantially elongated stop member to the printing press;

substantial horizontal displacement guide means for guiding a substantially horizontal displacement of the pivotally mounted second end of said substantially elongated stop member; and a lever arm, a first end of said lever arm being pivotally connected to the printing press, and the second end of said lever arm being pivotally connected to said substantially elongated stop member.

11. A printing press according to claim 10, further comprising a substantially elongated mounting member, said substantially elongated mounting member being connected to the printing press and disposed substantially horizontally, said substantially elongated mounting member having a substantially horizontally disposed slot formed therein, wherein said substantial horizontal displacement guide means for guiding a substantially horizontal displacement of said pivotally mounted second end of said substantially elongated stop member comprises the positioning of said first pivotal mounting means within said substantially horizontally disposed slot for sliding substantially horizontal movement therein, and wherein said first end of said lever arm is pivotally connected to said mounting member.

12. A printing press according to claim 11, wherein said pivotal connection of said first end of said lever arm to said mounting member is substantially horizontally spaced from said substantially horizontally disposed slot formed in said mounting member.

13. A printing press according to claim 12, wherein said substantially elongated stop member comprises a substantially L-shaped member, said substantially L-shaped member having an outstanding leg portion projecting towards said receiving surface means.

14. A printing press according to claim 13, wherein said second end of said lever arm is pivotally connected to said substantially elongated stop member substantially intermediate said outstanding leg portion and said second end of said substantially elongated stop member.

15. A printing press according to claim 14, wherein the outer projecting end of said outstanding leg portion has a curved surface.

* * * * *

UNITED STATES PATENT AND TRADEMARK OFFICE

CERTIFICATE OF CORRECTION

PATENT NO. : 5,054,765

DATED : October 8, 1991

INVENTOR(S) : Manfred HENN and Carsten KELM

It is certified that error appears in the above-indentified patent and that said Letters Patent is hereby corrected as shown below:

In Column 5, line 46, Claim 7, delete "substantially" and insert --substantial--.

On the face of the patent after item [22], insert item [30]. It should read:

--Foreign Application Priority Data

Nov. 7, 1989 [DE] Fed. Rep. of Germany .....
G 89 13 127.4

Signed and Sealed this

Thirtieth Day of August, 1994

*Attest:*

*Attesting Officer*

Bruce Lehman

BRUCE LEHMAN

*Commissioner of Patents and Trademarks*